US006557185B1

(12) United States Patent
Lee

(10) Patent No.: US 6,557,185 B1
(45) Date of Patent: May 6, 2003

(54) DEVICE FOR AFFIXING A LENS ONTO A SAFETY HELMET

(75) Inventor: Te Lung Lee, Yung-Kang (TW)

(73) Assignee: Long Huei Helmet Co., Tainan (TW)

( * ) Notice: Subject to any disclaimer, the term of this patent is extended or adjusted under 35 U.S.C. 154(b) by 0 days.

(21) Appl. No.: 10/014,272

(22) Filed: Oct. 22, 2001

(51) Int. Cl.[7] ..... A42B 1/08
(52) U.S. Cl. ..... 2/424
(58) Field of Search ..... 2/424

(56) References Cited

U.S. PATENT DOCUMENTS

| | | | | | |
|---|---|---|---|---|---|
| 4,794,652 | A | * | 1/1989 | Piech von Planta et al. | 2/424 |
| 5,461,731 | A | * | 10/1995 | Shida | 2/424 |
| 6,260,213 | B1 | * | 7/2001 | Eom et al. | 2/424 |

FOREIGN PATENT DOCUMENTS

| | | | | | |
|---|---|---|---|---|---|
| DE | 4417658 | A1 | * | 11/1995 | A42B/3/04 |
| FR | 2759869 | A1 | * | 8/1998 | A42B/3/22 |
| JP | 04185704 | A | * | 7/1992 | A42B/3/22 |

* cited by examiner

*Primary Examiner*—Rodney M. Lindsey
(74) *Attorney, Agent, or Firm*—Pro-Techtor International Services

(57) ABSTRACT

The invention provides device for affixing a lens of a safety helmet. A helmet housing has a base located on each of both sides. The base has a C-like protruding ring. The protruding ring has an upward opening gap, wherein an inner side surface has a C-like groove. A protruding body is located under the protruding ring, wherein a bottom of the protruding body has a concave clicking opening. A side front portion of the protruding ring has clicking protruding body having a top with a slant surface. A windshield lens of safety helmet has a base plate at each of both sides, which base plate can be affixed onto the base of the helmet housing. An inner side of the base has two L-like clicking protruding bodies, which can be inserted to the C-like groove. A clicking gear is formed on the base plate at a bottom rim corresponding to the protruding body of the base. The front portion of the clicking gear has a position protruding body that can associate with the clicking protruding body to have the effect of lifting position restriction. In this manner, the assembling process can be easily is performed without need of using an assembling tool and a screw member.

3 Claims, 10 Drawing Sheets

(A-A)

(B-B)

(B)

(A)

DEVICE FOR AFFIXING A LENS ONTO A SAFETY HELMET

BACKGROUND OF THE INVENTION (a) Field of the Invention

The present invention is to provide an improved device for affixing a lens onto a safety helmet. More particularly, the invention relates to a device that can affix the windshield lens of safety helmet to the helmet housing with easy and convenient assembling and disassembling without using assembling tools and screw fixing members.

(b) Description of the Prior Art

In general, the assembling structure between helmet housing 1 and windshield lens 2 of the convention safety helmet is schematically shown in FIG. 1. Both sides of the windshield lens 2 each have a clicking-positioning ring 20 with a click structure and a void inner part. The corresponding both sides of helmet housing 1 has two screw holes 10, 11. In addition, each of the both sides of the helmet housing uses an ear cap 3 to mount the windshield lens 2 to the helmet housing 1. The structure of ear cap 3 includes ear holes 30, 31 with respect to the screw holes 10, 11 at the two opposite sides of the helmet housing 1. In addition, one ear hole 30 has a clicking base 300, which is located at the inner rim of the ear hole 30 and can be used by the clicking-positioning ring 20 of windshield lens 2 to affix thereon. The clicking base 300 also provides a clicking-position function when the windshield lens 2 is lift up in angle or closed. By the foregoing assembling, it additionally associates with two screw pieces 40 to screw into the ear hole 30, 31 of the ear cap 3, wherein a screwdriver is used to affix the screw pieces 40. After that, the windshield lens 2 is then mounted on the helmet housing 1.

Apparently, in the conventional method, when the windshield lens 2 is mounted on the helmet housing 1, it still needs the tool of screwdriver to tight the screw pieces 40 to accomplish the assembling effect. For the manufacturer, the assembling process is more complicate and inconvenient. For the user, it needs the tool to complete a change (assembling or disassembling). Apparently, it consumes time and cost.

DETAILED DESCRIPTION OF THE PREFERRED EMBODIMENTS

The inventor provides a preferred embodiment for description as follows:

First, FIG. 2 is a drawing, illustrating a dissect structure between the windshield lens of safety helmet 5 and helmet housing 6, according to the invention.

The helmet housing 6 at each of the both sides has a base 61 affixed by a rivet set 60. The outside of the base 61 at the center and slightly upper position has an opening gap 620 directing up to form a C-like protruding ring 62. A C-like groove 63 is formed at the inner rim of the protruding ring 62 (also see FIG. 12). An arc protruding body 64 is located under the C-like protruding ring 62. Two protruding rims 65 are formed at bottom of the protruding body 64 (also see FIG. 3). The concave clicking opening 66 is then formed between the two protruding rims 65. A clicking protruding body 67 with a slant surface 670 on top is formed on the C-like protruding ring 62 at side front portion and slightly lower position. The clicking protruding bodies 67 have an opening gap 620 about at 90 degrees perpendicular direction, such as the $\alpha$ angle shown in FIG. 3. The opening gap 620 is located above the clicking protruding bodies 67.

The windshield lens of safety helmet 5 has a base plate 50 at each side of the helmet housing 6 to affix on the base 61. The inner side of the base plate 50 with respect to the C-like space separated by the C-like protruding ring 62 of the base 61 is equipped with two L-like clicking protruding bodies 51, 52 with left-right inversing direction (also shown in FIG. 11). The two clicking protruding bodies 51, 52 each have a slant surface to ease the insertion into the C-like groove 63. The separated width A by the two clicking protruding bodies 51, 52 is larger than the inner diameter B1 of the C-like protruding ring 62 but smaller than a diameter B2 of the C-like groove 63. While assembling, the width of the opening gap 620 of the C-like protruding ring 62 on the base 61 allows the two clicking protruding bodies 51, 52 of the base plate 50 at two sides of the windshield lens of safety helmet 5 to be inserted, as shown in FIG. 4. The windshield lens of safety helmet 5 can be inserted to the C-like groove 63 from the bottom of the L-like clicking protruding bodies 51, 52 and is stopped by the top rim 621 of the C-like protruding ring 62 with respect to the C-like groove 63 without sliding off The helmet housing on the helmet housing 6 has a lifting function. The lifting angle of the windshield lens of safety helmet 5 can be adjusted and positioned. An arc clicking gear 53 is formed in the corresponding portion at the bottom rim of the base plate 50 on both sides of the windshield lens of safety helmet 5, and facing the base 61 of the helmet housing 6. The protruding gear 530 of the clicking gear 53 can be engaged with a clicking concave opening 66 at the bottom of the arc protruding body 64, whereby a concave/convex coupling state is achieved. This allows the windshield lens of safety helmet 5 to be stably affixed on the position for the windshield lens of safety helmet 5 being lifted-up by any angle. Moreover, in order to have a limit of lifting angle for the windshield lens of safety helmet 5, a position clicking protruding body 54 is outwardly formed at the side front portion of the arc clicking gear 53. The position clicking protruding body 54 with respect to the clicking protruding bodies 67 of the helmet housing 6 can form the effect for setting the maximum position, as shown in FIGS. 5 and 7–8.

In the foregoing assembling, when the windshield lens of safety helmet 5 is to be affixed to the helmet housing 6, it only needs to insert the clicking protruding body 52 at the inner side front portion of the base plate 50 on the windshield lens of safety helmet 5 into the C-like groove 63 of the helmet housing 6, as shown in FIGS. 3 and 4. Then, another clicking protruding body 51 is inserted into along the opening gap 620 of the C-like protruding ring 62 on the helmet housing 6. In this situation, the windshield lens of safety helmet 5 is at the lifted-up state by an angle. Therefore, It the only needs to close the windshield lens of safety helmet 5, as shown in FIG. 5, wherein the two clicking protruding bodies 51, 52 is shifted and rotated in the C-like groove 63. At the same time, the position clicking protruding body 54 of the windshield lens of safety helmet 5 then is shifted in press along the top slant surface 670 of the clicking protruding bodies 67 of the helmet housing 6. When the position clicking protruding body 54 is separated from the top slant surface 670 of the clicking protruding bodies 67, it would engage with the clicking protruding bodies 67 to form a clicking-positioning state at the position. Since the opening gap 620 of the of the base 61 of the helmet housing 6 is about perpendicular to the position clicking protruding body 54 of the base plate 50 of the windshield lens of safety helmet 5 and the opening gap 620 is located above the position clicking protruding body 54, the windshield lens of safety helmet 5 is firmly affixed onto the helmet housing 6 without sliding off. In addition, the arc clicking gear 53 of the base plate 50 of the windshield lens of safety helmet 5 is engaged with the concave clicking opening 66 on the helmet housing 6 in a clicking-positioning state. The lifting angle or close state of the windshield lens of safety helmet 5 can be freely adjusted through the arc clicking gear 53 as shown in FIGS. 6, 9, and 10.

When the windshield lens of safety helmet 5 is to be detached from the helmet housing 6, it only needs to slightly push-up the position clicking protruding body 54 of the base on the windshield lens of safety helmet 5 and cross over the clicking protruding bodies 67 of the helmet housing 6. After that, the whole windshield lens of safety helmet 5 can be pulled over, and the protruding body 51 can be aligned to the opening gap 620 of the C-like protruding ring 62. As a result, the windshield lens of safety helmet 5 can be easily detached from the helmet housing 6.

Therefore, according to the foregoing description, the invention can assemble the helmet housing onto the windshield lens of safety helmet at the designed position without need of using any assembling tools and screw member. The assembling and detaching process can be easily and promptly achieved. The invention indeed has significantly improved the function with unexpected result, and can have great practical use.

Furthermore, in the foregoing embodiment, the base plate 50 with respect to the C-like protruding ring 62 of the base 61 can be implemented with a portion of arc ring 55 to support each other.

In summary, the present invention has achieved the application in industry.

Moreover, the features of the structure of the invention have not been disclosed in publication with satisfying the novelty.

SUMMARY OF THE INVENTION

Therefore, the inventor has considered and developed to effectively improve the present invention.

Therefore, the primary object of the invention is to provide an improved device for affixing a lens onto a safety helmet. The invention can assemble the windshield lens of safety helmet on to the helmet housing 1 without need of using the assembling tools and the screw assembling parts, so as to ease the assembling and disassembling process.

Figure 1:
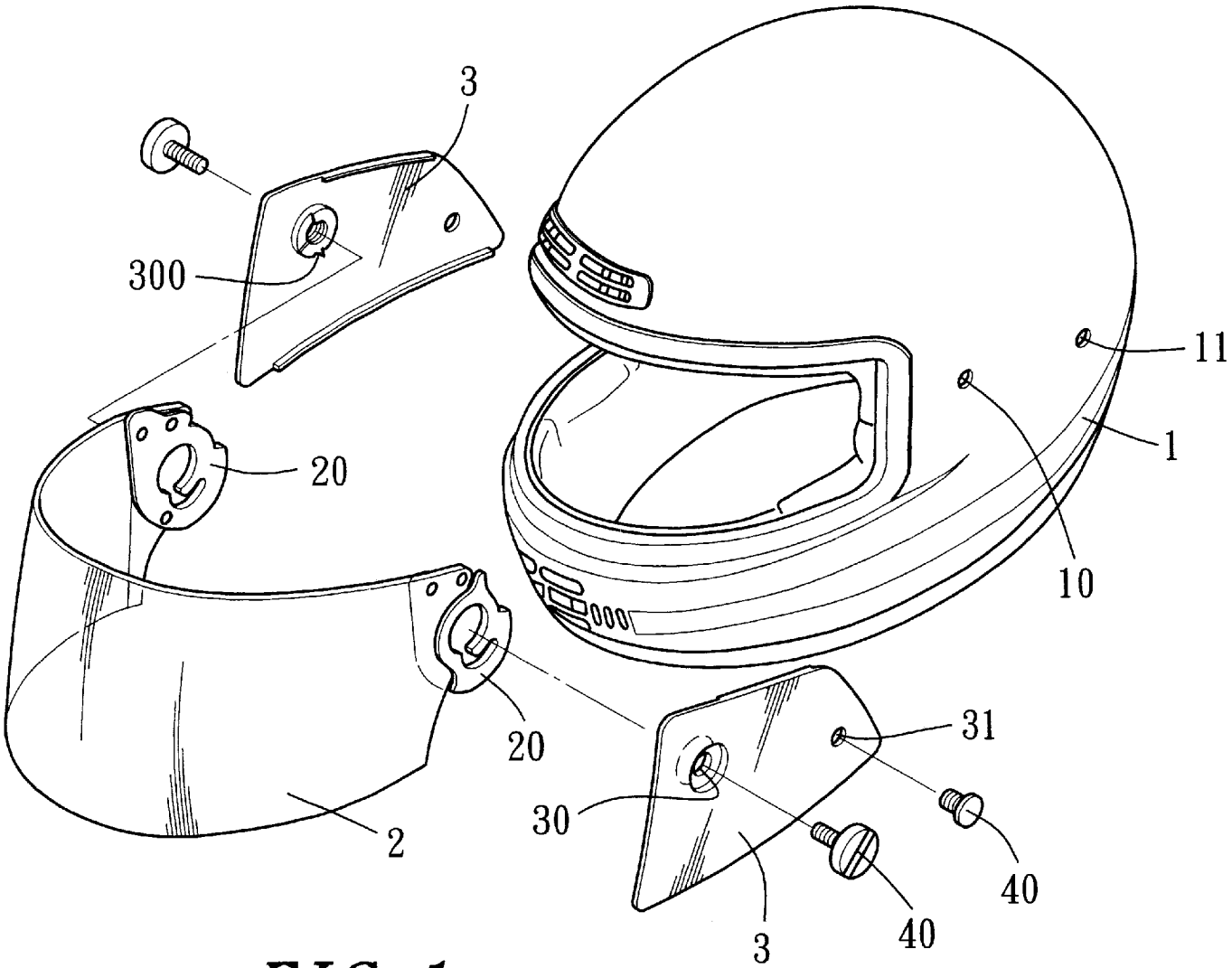
FIG. 1 (PRIOR ART)
FIG. 1 is a dissected drawing, illustrating a conventional lens of safety helmet for assembling.
Figure 2:
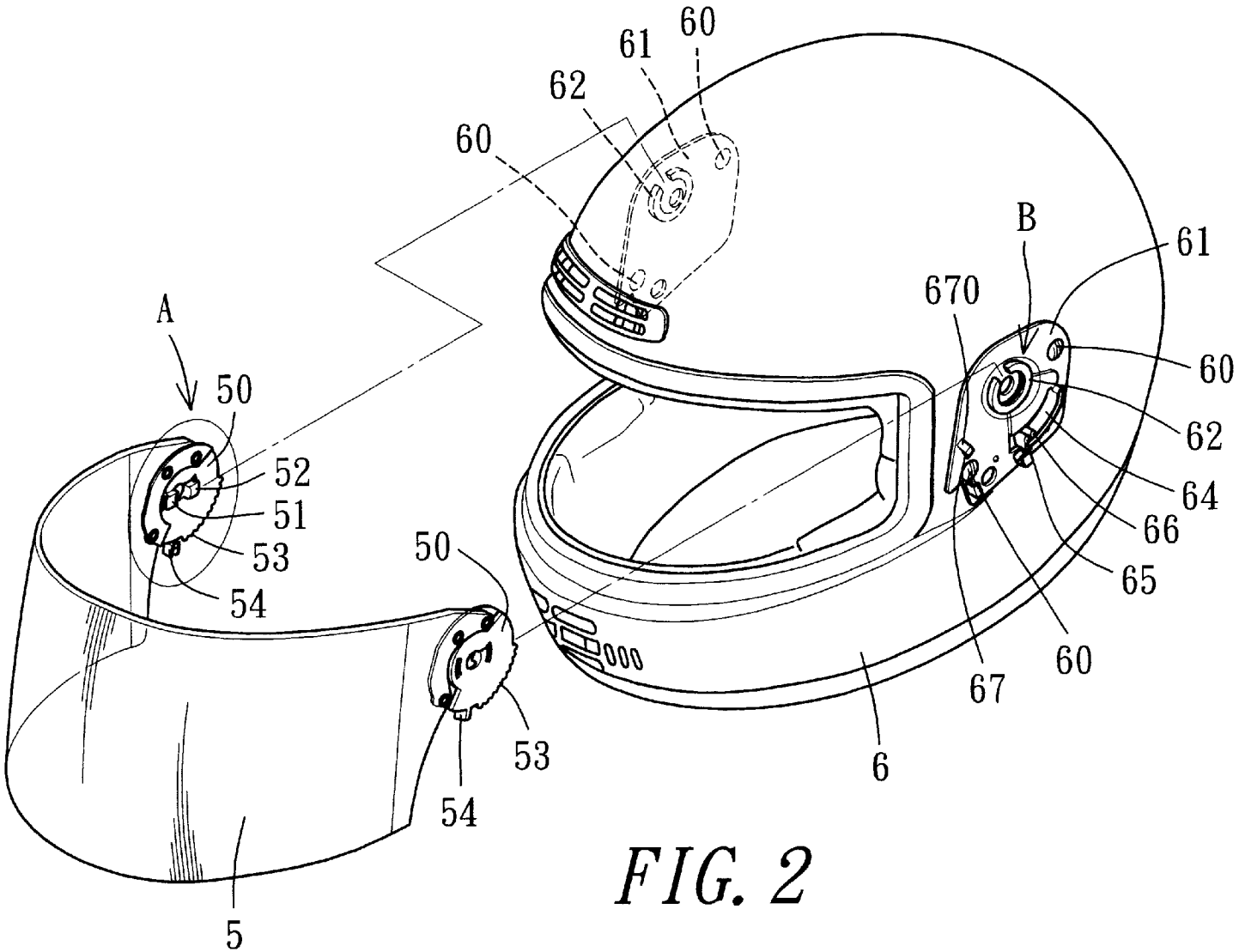
FIG. 2 is a dissected drawing, illustrating a lens of safety helmet for assembling, according to the invention.
Figure 3:
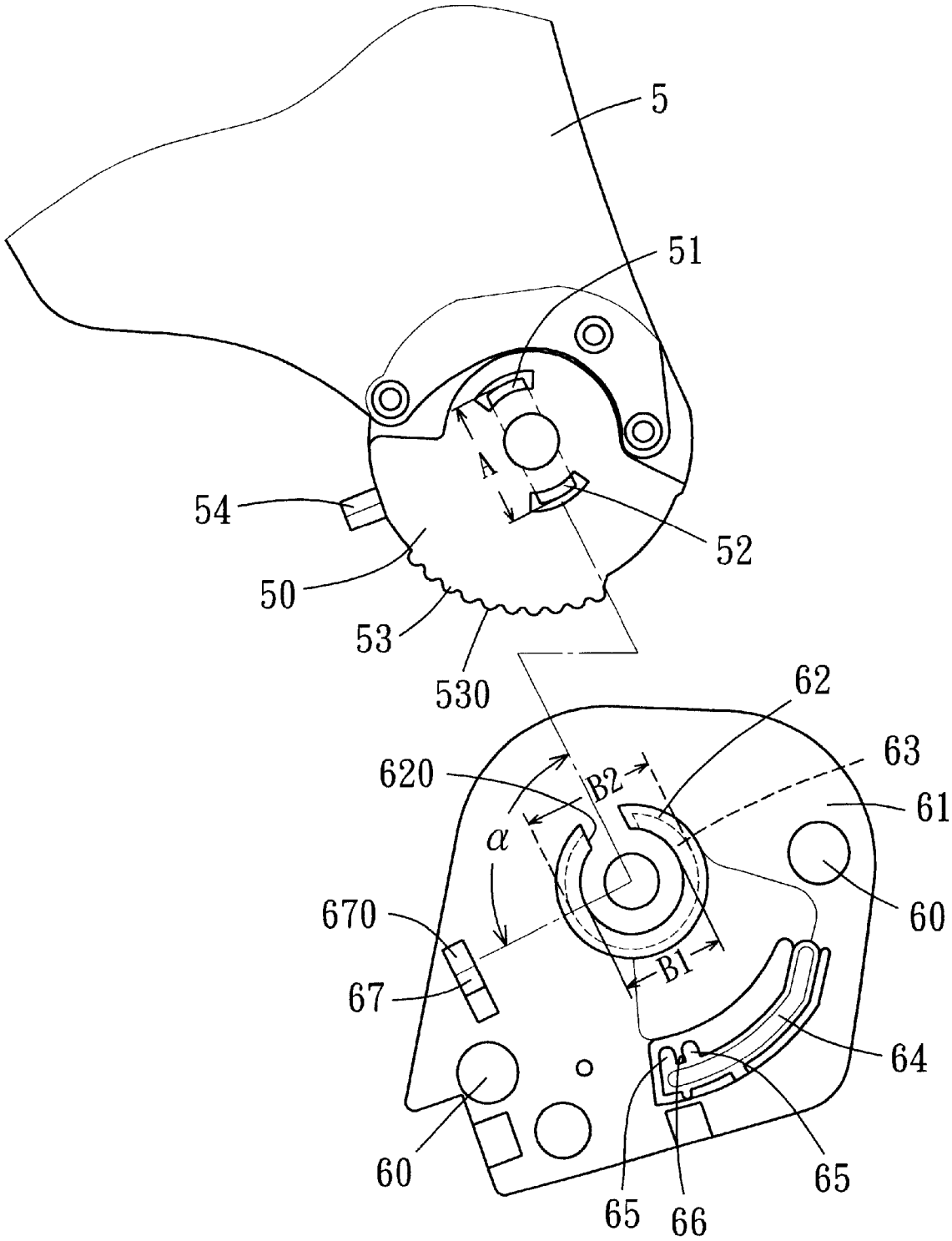
FIG. 3 is a drawing, illustrating the structure and action for assembling the lens to the safety helmet in the first part, according to the invention.
Figure 4:
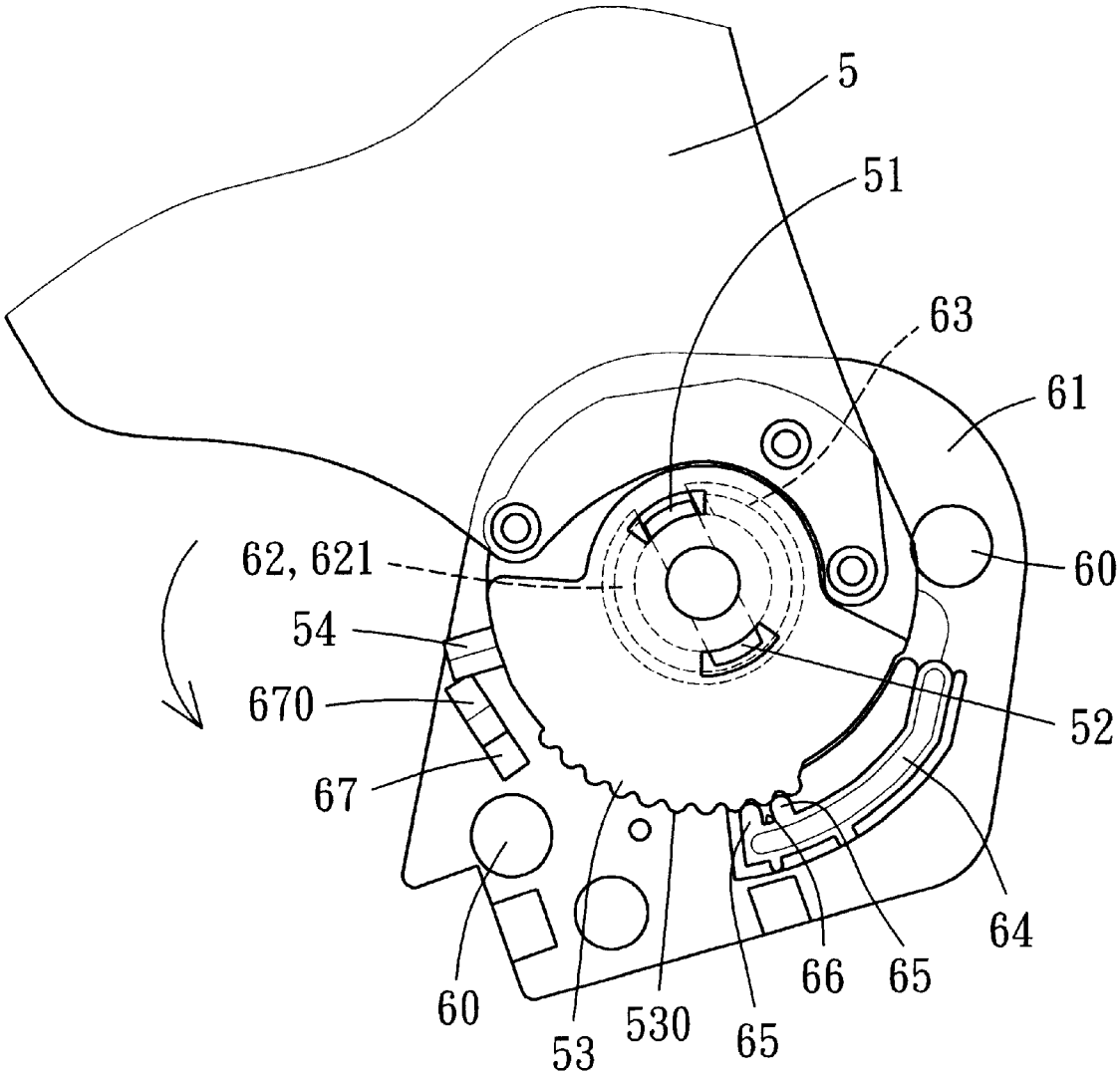
FIG. 4 is a drawing, illustrating the structure and action for assembling the lens to the safety helmet in the second part, according to the invention.
Figure 5:
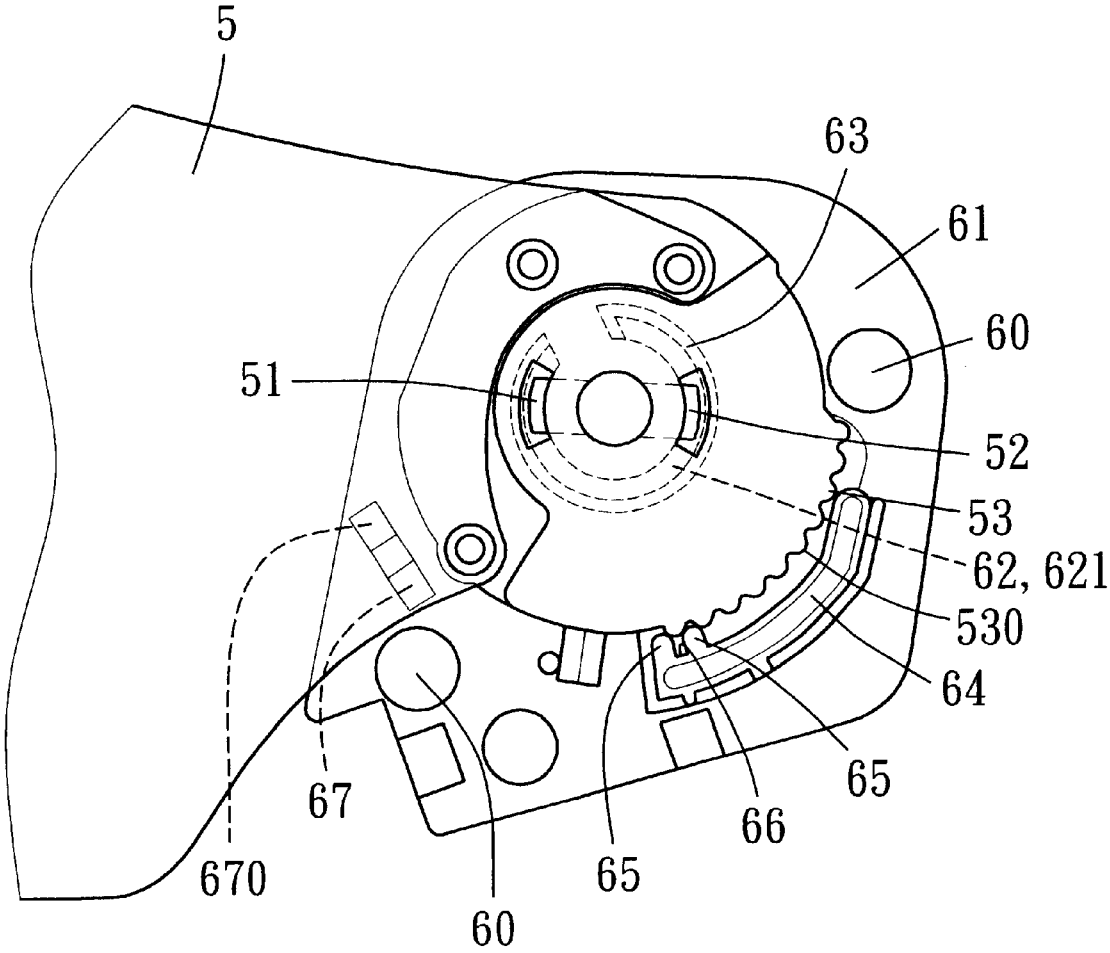
FIG. 5 is a drawing, illustrating the structure and action for assembling the lens to the safety helmet in the third part, according to the invention.
Figure 6:
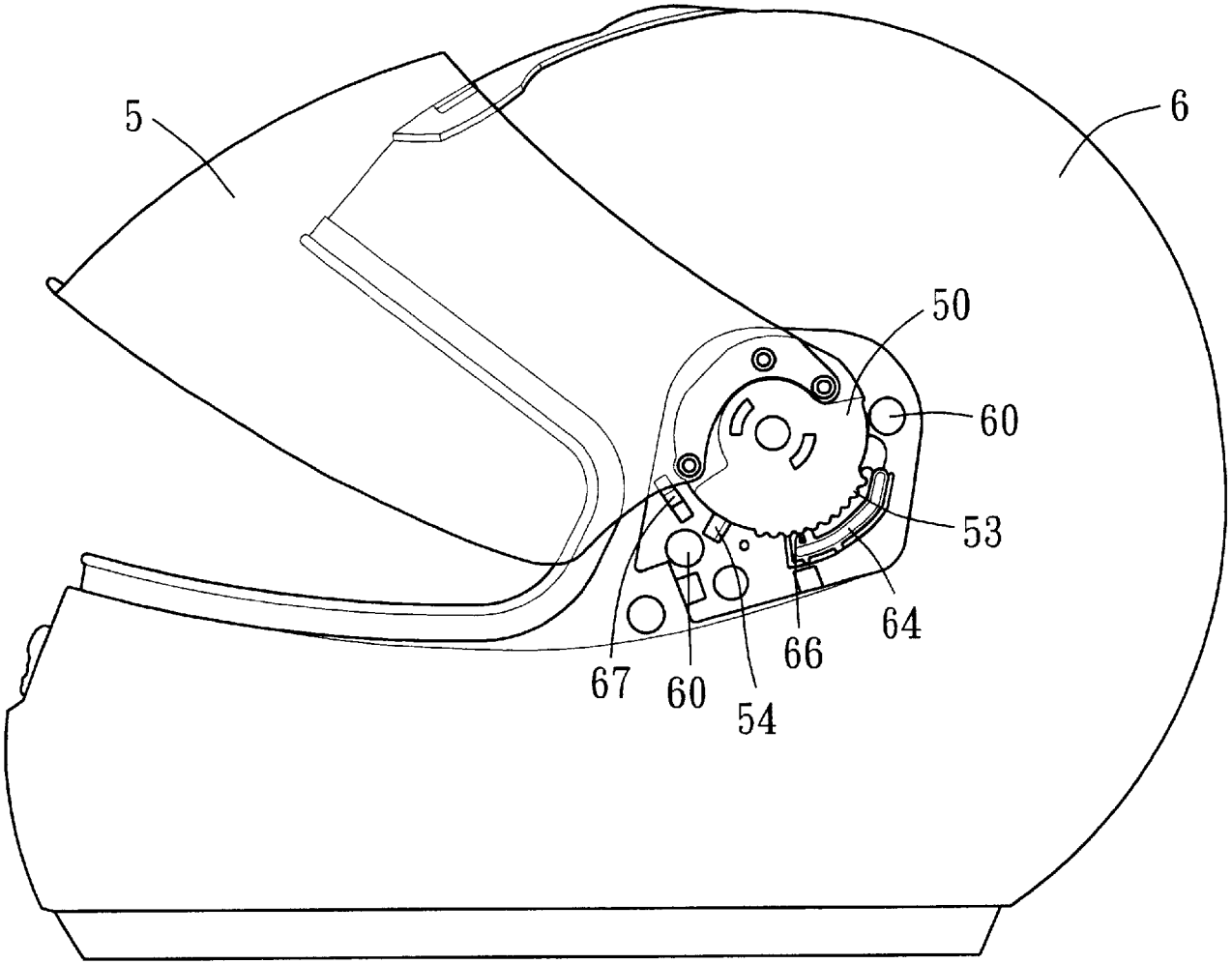
FIG. 6 is a perspective view, illustrating the assembled safety helmet, according to the invention.
Figure 7:
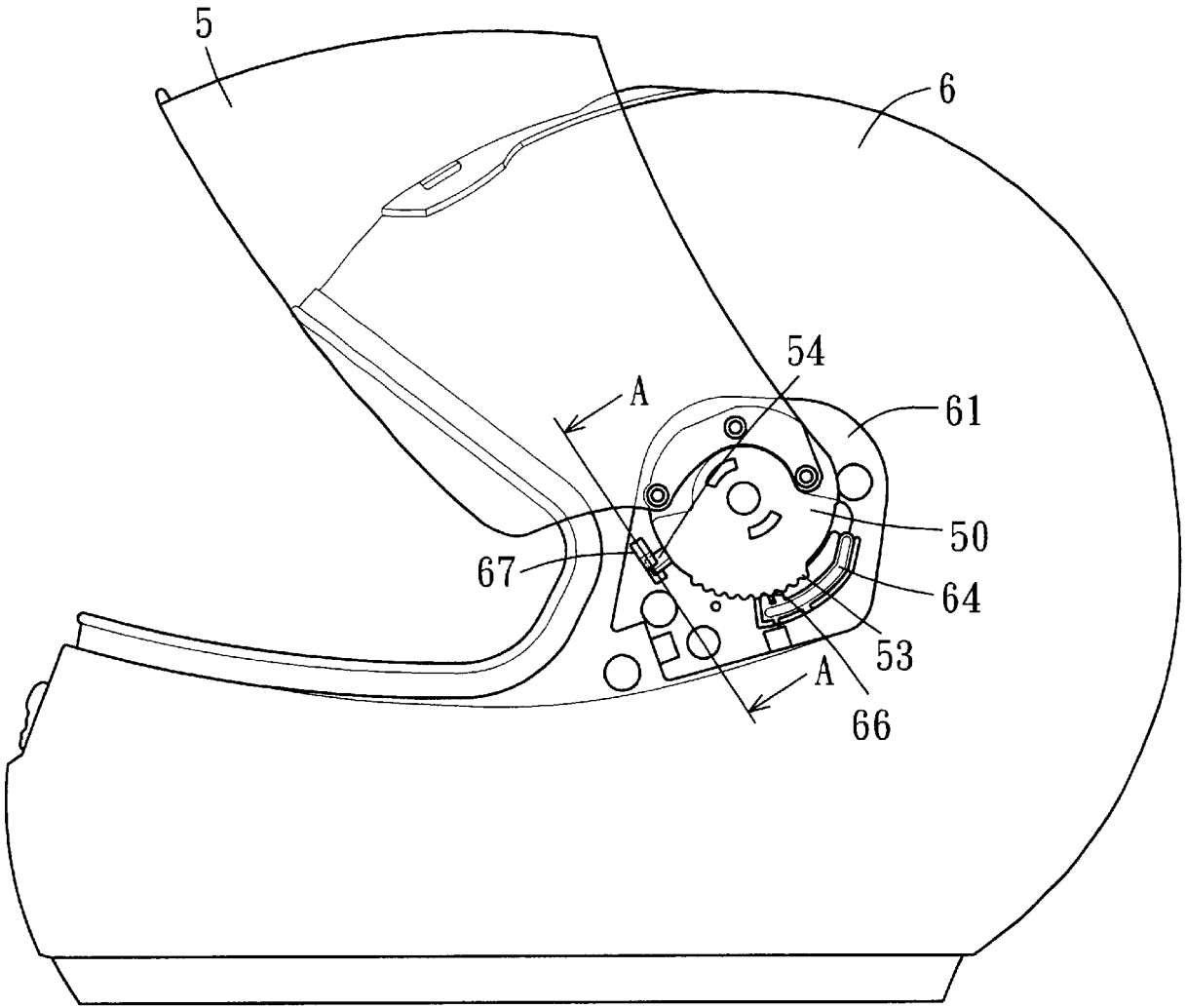
FIG. 7 is a side view, illustrating the lens of safety helmet being lift-up in a large angle, according to the invention.
Figure 8:
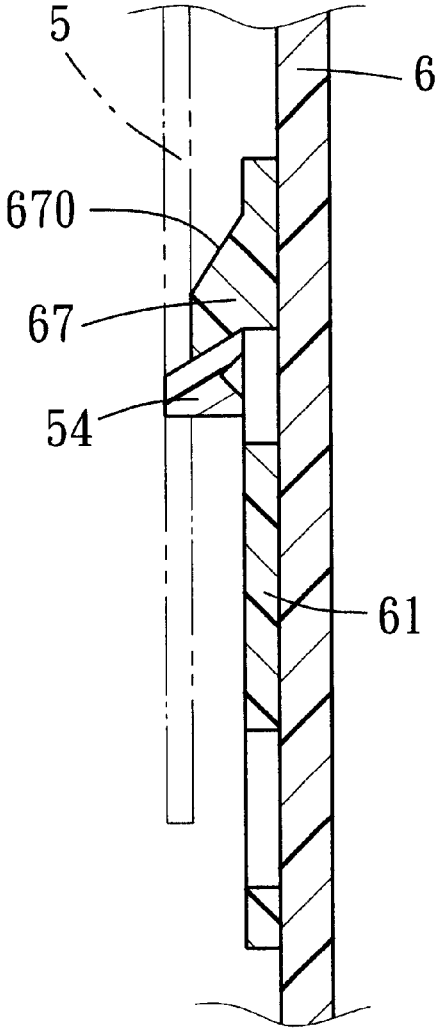
FIG. 8 is a cross-sectional view, illustrating the structure of FIG. 7 cutting along the line of A—A.
Figure 10:
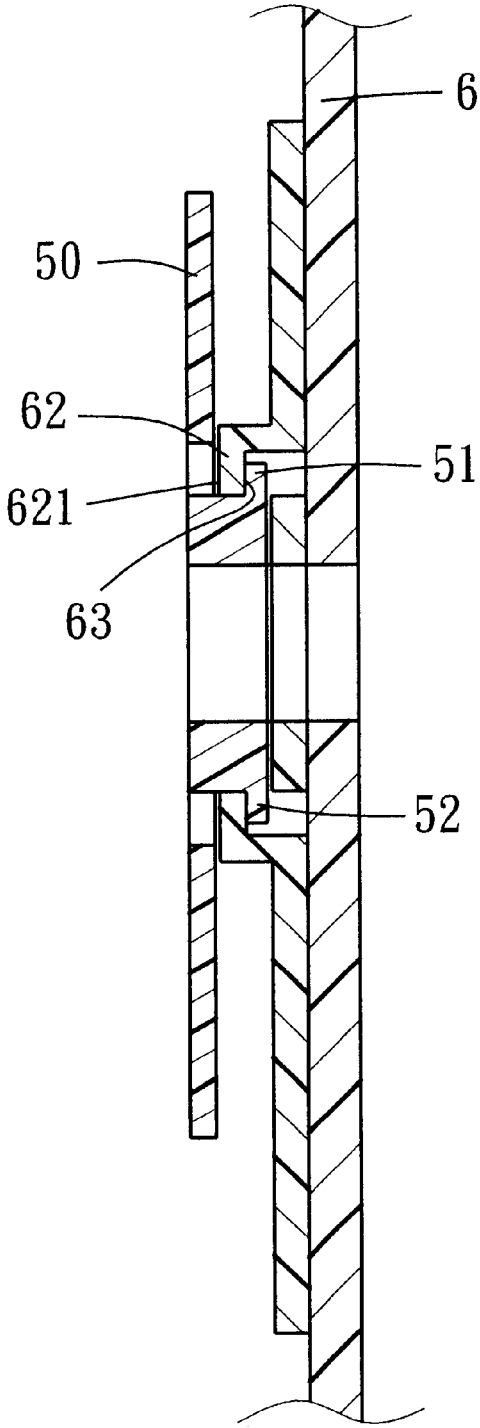
FIG. 10 is a cross-sectional view, illustrating the structure of FIG. 9 cutting along the line of B—B.
Figure 9:
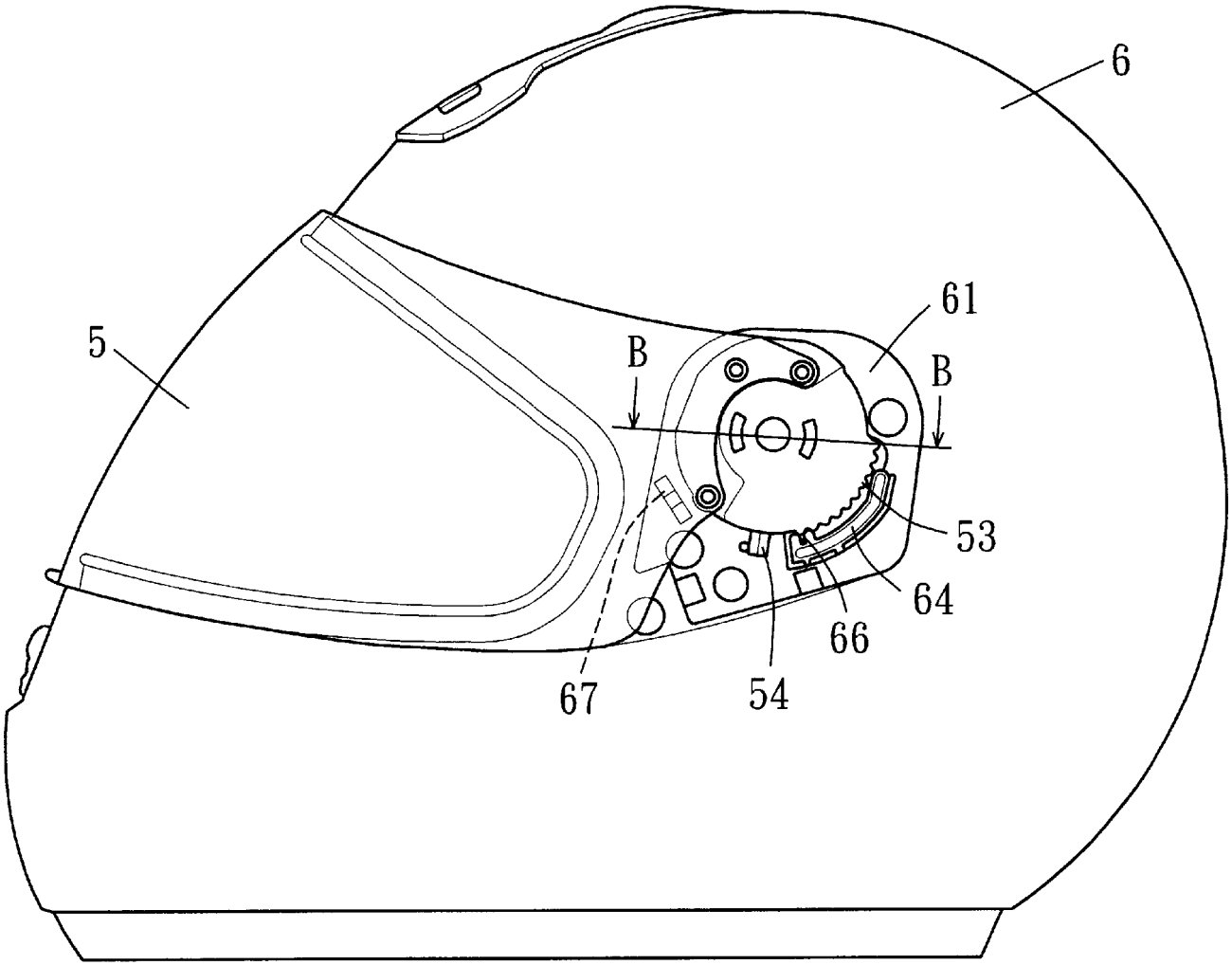
FIG. 9 is a side view, illustrating the lens of safety helmet being closed, according to the invention.
Figure 12:
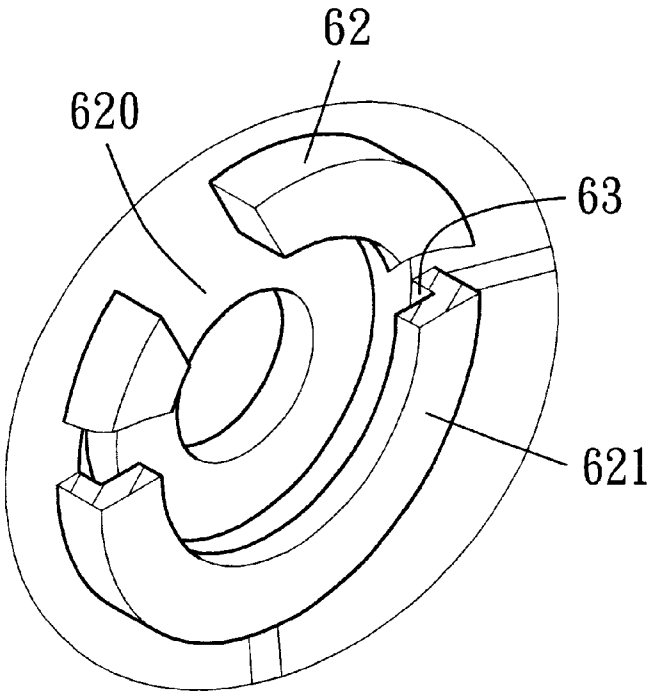
FIG. 12 is a magnified drawing of FIG. 2 at the position B.
Figure 11:
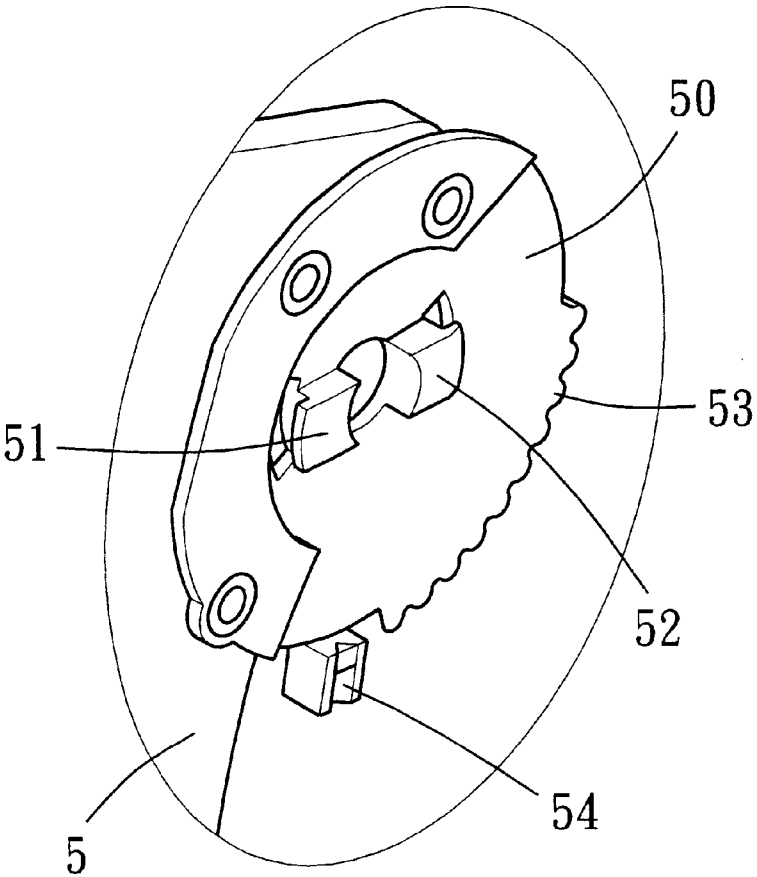
FIG. 11 is a magnified drawing of FIG. 2 at the position A.

I claim:

1. A device for affixing a lens of a safety helmet, comprising:

a helmet housing of safety helmet, having a base located on each of both sides, a side front portion of the base having a C-like protruding ring, the C-like protruding ring having an upward opening gap, wherein an inner surface separated from a C-like wall of the C-like protruding ring forms a C-like groove, and a protruding body is located under the protruding ring, wherein a bottom of the protruding body has a concave clicking opening, and a side front portion of the protruding ring has clicking protruding body having a top with a slant surface; and a windshield lens of safety helmet, having a base plate at each of both sides which base plate can be affixed onto the base of the windshield lens of safety helmet, an inner side of the base with respect to a C-like space separated from the C-like protruding ring has two L-like clicking protruding bodies with left-right inversing arrangement, wherein a width separated by the clicking protruding body is greater than an inner diameter of the C-like protruding ring and less than a crossing range of the C-like groove, a width of opening gap of the C-like protruding ring allows the protruding body to be inserted, and a clicking gear is formed on the base plate at a bottom rim corresponding to the protruding body of the base of the windshield lens of safety helmet, wherein the clicking gear has protruding gear that can match with concave clicking opening to form a concave/convex clicking state, and a side front part of the clicking gear has a position protruding body with respect to the clicking protruding body, used to restrict a position limit;

wherein the helmet housing can use the protruding body of the base plate at the both sides to insert into the C-like groove of the windshield lens of safety helmet, wherein the position protruding body can associate the clicking protruding body of the windshield lens of safety helmet for performing clicking, the clicking gear can click with the concave clicking opening of the protruding body, so as to provide the function for adjusting the windshield lens by a lifting angle, and assembling process can be easily performed without need of using an assembling tool and a screw member.

2. The device of claim 1, wherein the base plate with respect to the base of the C-like protruding ring includes an arc ring to support each other.

3. The device of claim 1, wherein the opening gap of the base of the helmet housing is about perpendicular to the protruding body and the opening gap is located above the clicking protruding body.

* * * * *